US005533378A

United States Patent [19]

Boeck et al.

[11] Patent Number: 5,533,378

[45] Date of Patent: Jul. 9, 1996

[54] VEHICLE HEADER ALIGNMENT APPARATUS

[75] Inventors: Harold W. Boeck, Algonac; David M. Wargnier, Sterling Heights; Charles Baurhenn, Chesterfield, all of Mich.

[73] Assignee: Chrysler Corporation, Auburn Hills, Mich.

[21] Appl. No.: 494,426

[22] Filed: Jun. 26, 1995

[51] Int. Cl.[6] ..... B21D 11/02

[52] U.S. Cl. ..... 72/302; 72/407; 72/705

[58] Field of Search ..... 72/705, 453.18, 72/407, 302, 442

[56] References Cited

U.S. PATENT DOCUMENTS

| | | | |
|---|---|---|---|
| Re. 30,914 | 4/1982 | Chisum | 72/457 |
| 1,875,448 | 9/1932 | Hanna | 72/407 |
| 2,939,507 | 6/1960 | Miller | 153/48 |
| 2,959,313 | 11/1960 | Bettencourt et al. | 214/731 |
| 3,272,364 | 9/1966 | Mindrum et al. | 214/654 |
| 3,737,007 | 6/1973 | Herrell | 182/210 |
| 3,741,029 | 6/1973 | Bellemare | 72/419 |
| 4,044,857 | 8/1977 | Guerette | 182/17 |
| 4,138,876 | 2/1979 | Chisum | 72/457 |
| 4,400,968 | 8/1983 | Barbieri . | |
| 4,555,926 | 12/1985 | Bieli-Moschlin et al. | 72/392 |
| 4,936,731 | 6/1990 | Noble | 414/401 |
| 4,949,569 | 8/1990 | Young et al. | 72/705 |
| 5,098,249 | 3/1992 | Noble | 414/401 |
| 5,209,536 | 5/1993 | Rogers, Sr. | 294/88 |
| 5,440,912 | 8/1995 | Copeman | 72/407 |

FOREIGN PATENT DOCUMENTS

| | | | |
|---|---|---|---|
| 0667477 | 6/1979 | U.S.S.R. | 72/705 |

*Primary Examiner*—Daniel C. Crane
*Assistant Examiner*—Ed Tolan
*Attorney, Agent, or Firm*—G. Andrew Barger

[57] ABSTRACT

A header alignment apparatus for a vehicle. The header alignment apparatus having a substantially vertically upright extension pole that moves upward during a contraction mode and remains in a set position during an expansion mode. An L-shaped upper actuator sleeve is provided that is movable in the axial direction of the vertically upright extension pole and includes an upper actuator clamp, integrally formed therewith, for engaging a header of the vehicle. An adjustable L-shaped lower actuator sleeve is attached to the vertically upright extension and is movable in the axial direction of the vertically upright extension pole and includes a lower actuator clamp, integrally formed therewith, for engaging a bumper of the vehicle. A self-centering ram is provided for performing a simultaneous function of lowering the upper actuator clamp and raising the lower actuator clamp so that the header is lowered during the contraction mode, and also performing the simultaneous function of raising the upper actuator clamp and lowering the lower actuator clamp so that the header is raised during the expansion mode.

9 Claims, 5 Drawing Sheets

71b
70
72
71a
58
75
56
47a
78
45
24
80
32a
32b
10
76
26b
37
26a
48
30
28b
74
34
38b
36
28a
38a
82
62a
60
62b
52
5
22b
20
64
18a
54
40
23
16b
5
14a
50
16a
18b
14c
14d 22b
40
22a
14b
50
18a
14a

VEHICLE HEADER ALIGNMENT APPARATUS

BACKGROUND OF THE INVENTION

1. Field of the Invention

The present invention relates, generally, to alignment apparatuses. In particular, the present invention relates to an apparatus for aligning a vehicle header or roof that has bowed, in convex or concave fashion, or is skewed to one side so that the rear door latches cannot engage.

2. Description of the Related Art

It has long been a source of concern in the vehicle industry that upper door frames, commonly referred to as headers, become bowed in convex or concave fashion due to the loading and unloading of cargo via fork lifts. Typically, when the header becomes bowed, the rear door latches will not engage thereby requiring the vehicle to be taken in for repair. Repair of the header is costly due to the fact that the vehicle must be left by the operator for repair at a later date and further since the proper tools, technicians, and service bays must be available.

A further concern in the industry is the tilting of the door frame and cargo compartment to one side when a heavy object presses against a side of the vehicle. Such tilting can easily occur given the current nature of construction of vehicle cargo bays which consists of light weight aluminum to aid in fuel economy. Thus, common vehicle cargo bays and attached door frames have sides and a header constructed of malleable aluminum that can be tilted to one side such that the rear door latches do not engage. When tilting of the cargo bay does occur, lengthy repair is required.

In the past, the primary method of repairing vehicle headers has been via the use of a chainfall and hook apparatus. In operation, a hook is attached to the vehicle header having a chainfall extending underneath the hook. Below the chainfall, and attached thereto, is a chain which is hooked to the bottom door frame by a first technician. A second technician is then required to scale a ladder and attach the chainfall and hook to the header. Once in place, the second technician operates the chainfall in a manner to pull the bowed header down into place such that the door latches become aligned and operable.

Use of the chainfall and hook apparatus is undesirable since it requires at least two repairmen to operate, and will not work if the vehicle header is bowed in a concave fashion requiting the header to be raised vertically. It is also a common practice in the industry to completely replace the header when it becomes damaged because the chainfall and hook apparatus is in effective in fixing the headers. In addition, a further limitation is that the vehicle must be parked in a service bay for lengthy repair if the chainfall and hook apparatus is used.

A possible, but unlikely option would be to use existing equipment for the repair of small containers to fix headers. This equipment, however, lacks many elements needed to perform the task of vehicular header repair and alignment. One such element that is lacking is a means providing proper sight inspection of header alignment. Since many different sizes of vehicles and manufacturers exist, there is no standard vehicle header height or rear door opening. It is therefore necessary to have sight inspection by a service technician for proper alignment of the vehicle header. Thus, if container repair equipment were to be used on a vehicle header, there would be no way a service technician could tell whether the header has been raised or lowered to its proper position such that the door latches are properly positioned.

A further limitation of the use of container repair equipment for header repair is that chains are commonly used between grab portions or members to provide the actuation forces. This requires the use of idler units such as chain sprockets. Use of such chains in a manufacturing setting, where vehicles are typically loaded and unloaded, is undesirable since dirt and debris can clog the chain and mechanism. Unlike hydraulically powered devices, prior art chain driven mechanisms fail to provide sufficient force to repair a vehicle header. The chains can also slip which further decreases performance.

Existing container repair equipment requires one clamp member to be placed on the ground for stability, or alternatively requires a slide carriage support to be secured to the ground when operating in the vertical direction. When one clamp member is placed on the ground, there is a decrease in available force such that the vehicle header may not be able to be repaired. Likewise, if the carriage support is secured to the ground, the apparatus will not be mobile and therefore will be of decreased utility in the manufacturing setting. A still further limitation with the use of container repair equipment for header repair is that a remote toggle switch is not typically provided whereby the service operator can desirably stand at a distance from the equipment when operating it.

SUMMARY OF THE INVENTION

The present invention provides a header alignment apparatus for a vehicle. The vehicle has a bumper, and a header that serves as the upper part of a door frame. The header alignment apparatus has a contraction mode and an expansion mode for aligning the header relative to a flat surface or ground. The header alignment apparatus comprises a vertically upright extension pole attached to the at least one stabilization pad, and the vertically upright extension pole moves upward during the header alignment apparatus contraction mode. An L-shaped upper actuator sleeve is provided and the vertically upright extension pole is inserted therethrough. The L-shaped upper actuator sleeve is movable in the axial direction of the vertically upright extension pole and has an upper actuator clamp, attached thereto, for engaging the header. A L-shaped lower actuator sleeve, that has the vertically upright extension pole inserted therethrough, is further included.

The lower actuator sleeve is movable in the axial direction of the vertically upright extension pole and has a lower actuator clamp, attached thereto, for engaging the bumper. A self-centering ram is attached to the L-shaped upper actuator sleeve at a first end and attached to the vertically upright extension pole at a point between the L-shaped lower actuator sleeve and the L-shaped upper actuator sleeve at a second end. The self-centering ram performs the simultaneous functions of lowering the upper actuator clamp and raising the lower actuator clamp so that the header is lowered during the contraction mode; and further performs the simultaneous function of raising the upper actuator clamp and lowering the lower actuator clamp so that the header is raised during the expansion mode.

The header alignment apparatus further includes a rectangular sleeve that has the vertically upright extension pole inserted therethrough. Visualization means are attached to the rectangular sleeve and allow a service technician to visually inspect the header for proper alignment by the apparatus.

Other objects, features and advantages of the present invention will become apparent by reference to the following detailed description when considered in conjunction with the accompanying drawings.

BRIEF DESCRIPTION OF THE DRAWINGS

In the drawings below, reference characters refer to like parts throughout the views, and wherein.

DESCRIPTION OF THE PREFERRED EMBODIMENT(S)

Figure 1:
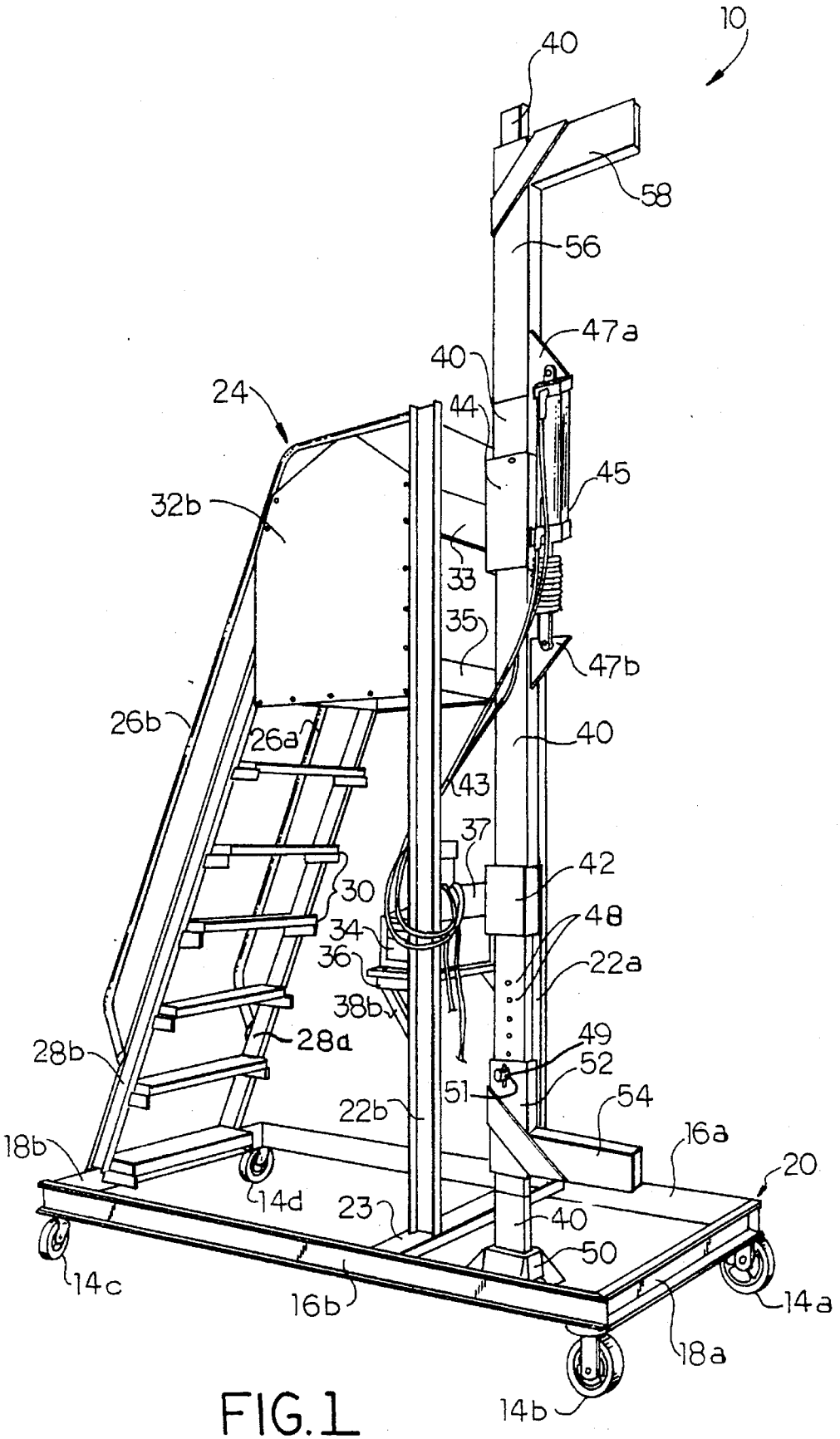
FIG. 1 is a perspective view of a header alignment apparatus of the present invention.

Commencing with FIG. 1, a header alignment apparatus 10 of the present invention is shown. The header alignment apparatus 10 has a base platform 20 that is of a generally rectangular shape. The platform 20 is constructed of two platform side bars 16*a* and 16*b* and two platform cross bars 18*a* and 18*b* to form a generally rectangular shape. Support wheels 14*a*, 14*b*, 14*c*, and 14*d* are attached to the platform 20. It is understood that the exact number of wheels is not determinative. Vertical support members 22*a* and 22*b* are also provided and attached to the platform 20 at platform cross member 23. The vertical support members 22*a* and 22*b* provide attachment support for various other components of the header alignment apparatus 10 that are vertically displaced from the platform 20.

Figure 2:
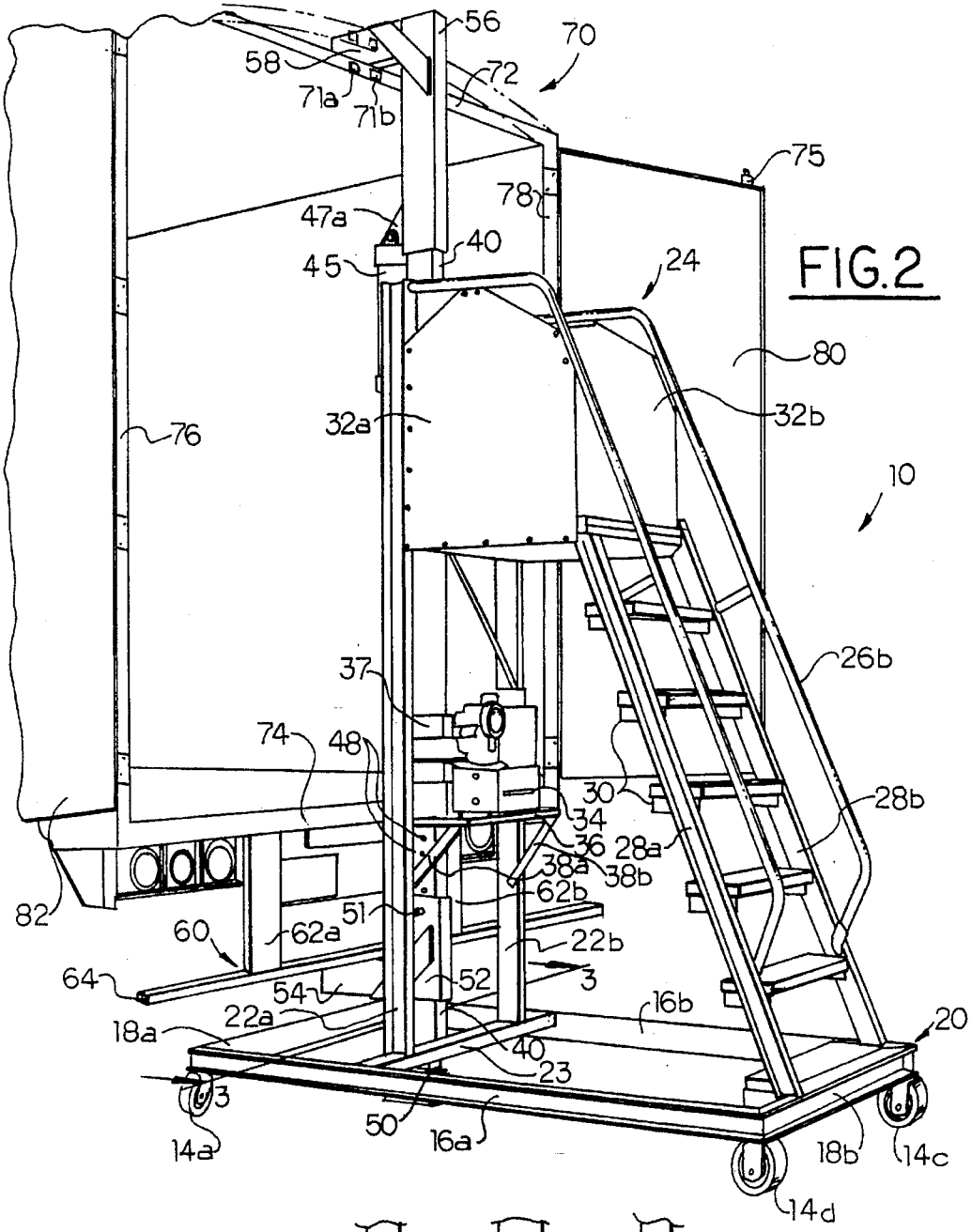
FIG. 2 is a perspective view of the header alignment apparatus of the present invention in position to align a header that is bowed in convex fashion.

A ladder access member 24 is provided to allow a service technician to visually inspect the header 72 of the vehicle door frame 70 as exemplarily shown in FIG. 2. It is appreciated by ones skilled in the art that other visualization means could also be employed such as gages or other service technician elevation means. The ladder access member 24 comprises support bars 28*a* and 28*b* that are disposed on either side of a plurality of stairs 30 in inclined fashion. Rails 26*a* and 26*b* are also provided for aiding a service technician when ascending or descending the plurality of stairs 30. The rails 26*a* and 26*b* are attached to their respective support bars 28*a* and 28*b*. Side walls 32*a*, 32*b*, and 32*c* are further provided to form side enclosures at the top of the ladder access member 24.

A controller 34 is provided for controlling a self-centering hydraulic ram 45. The controller receives electrical power via power cord 43. The controller 34 of the present invention is an ENGRPAC Model No. Per 3402B, while the self-centering ram 45 is a MILLER Model No. HU86B2N. It is understood, however, that other controllers and hydraulic rams could also be employed that display similar electrical, hydraulic, and mechanical properties. The controller 34 is mounted on a controller tray 36. The tray 36 is supported by two inclined support arms 38*a* and 38*b* each having a first end attached to the tray 36 and a second end attached to their respective vertical support members 22*a* and 22*b*.

FIG. 1 further shows a first cross piece 33 disposed between, and attached to, the vertical support members 22*a* and 22*b* near the top of the support members 22*a* and 22*b*. A first rectangular sleeve 44 is attached to the first cross piece 33. A second cross piece 35 is disposed between, and attached to, the vertical support members 22*a* and 22*b* near the mid section of the support members 22*a* and 22*b*. A third cross piece 37 is disposed between, and attached to, the vertical support members 22*a* and 22*b* near the lower section of the support members 22*a* and 22*b*. A second rectangular sleeve 42 is attached to the third cross piece 37.

A substantially upright, vertically oriented extension pole 40 is provided and is inserted through the first rectangular sleeve 44 and the second rectangular sleeve 42. The upright extension pole 40 has a plurality of bores 48 extending therethrough and is attached to a stabilization pad 50 which normally abuts against a flat surface. In the preferred embodiment, the upright extension pole 40 and stabilization pad 50 are placed within the rectangular platform 20. The self-centering ram 45 is attached at a first end to an extension 47*a* while a second end of the self-centering ram 45 is attached to extension 47*b*. An adjustable L-shaped lower actuator sleeve 52 is attached to the vertically upright extension pole 40 which is inserted through the lower actuator sleeve 52. The lower actuator sleeve 52 is movable longitudinally about the vertically upright extension pole 40 and comprises a lower actuator clamp 54 that is integrally formed therewith. The lower actuator sleeve 52 has at least one bore 51 that extends therethrough. The bore 51 is in axial alignment with one of the plurality of bores 48 of the extension pole 40.

Figure 7:
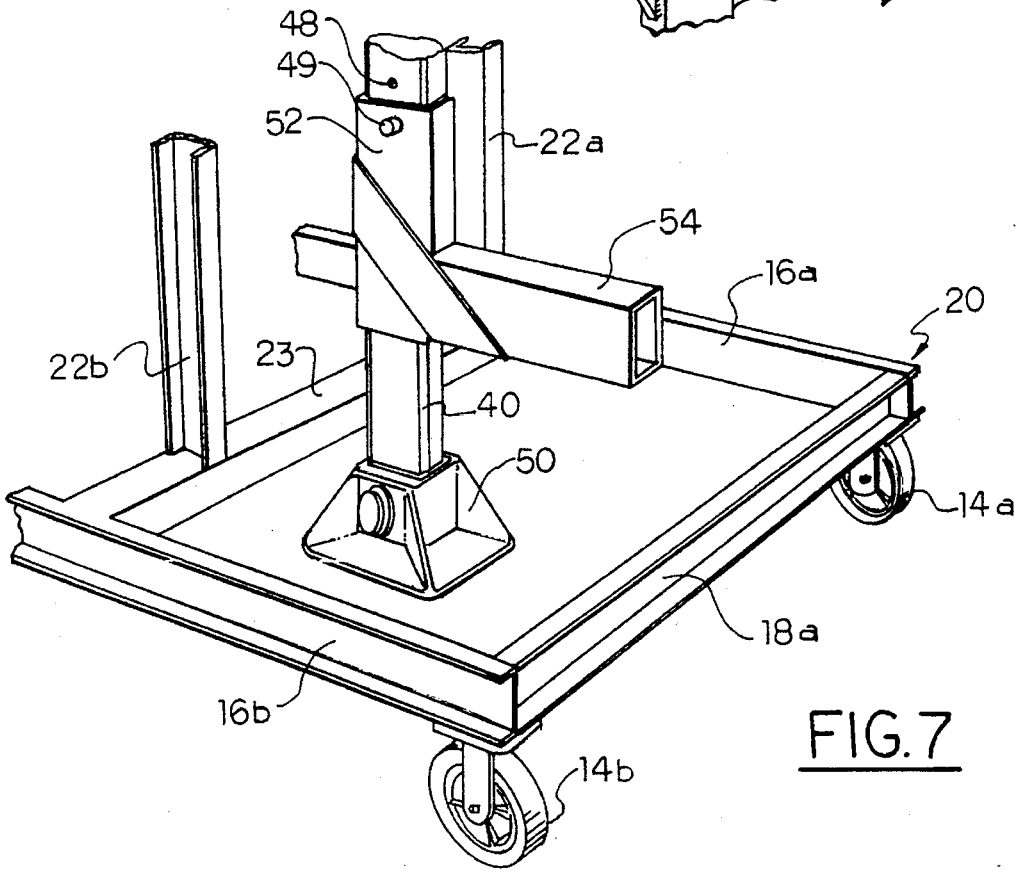
FIG. 7 is a perspective view of an L-shaped lower actuator sleeve having a lower actuator clamp attached thereto of the present invention.

A lower actuator adjuster means is provided for moving the adjustable L-shaped lower actuator 52 axially along the vertically upright extension pole 40. The lower actuator adjuster means connects the extension pole 40 and the lower actuator 52. In the preferred embodiment, as best shown in FIG. 7, the adjuster means comprises a pin 49 that is inserted through a bore 51 extending through lower actuator sleeve 52 and one of the plurality of bores 48 to attach the lower actuator sleeve 52 to the upright extension pole 40. It is understood that other adjuster means could also be employed such as a plurality of inclined teeth disposed between the lower actuator sleeve 52 and the extension pole 40. The vertically upright extension pole 40 extends through an adjustable L-shaped upper actuator sleeve 56. The upper actuator sleeve 56 comprises an upper actuator clamp 58 that is, in the preferred embodiment, integrally formed therewith.

Referring now to FIG. 2 a rectangular vehicle trailer door frame 70 is shown along with the vehicle header alignment apparatus 10 in a repair position. The door frame 70 comprises a first side 76, a second side 78, a header 72, and a bottom side 74. As shown in FIG. 2, the header 72 is misaligned by being bowed in convex fashion sufficient to prevent the vehicle door latches 75, attached to a vehicle door 80, from engaging door latch retainer mechanisms 71*a* and 71*b*.

In operation, the header alignment apparatus 10 is moved into place so that the upper actuator clamp 58 of the upper actuator sleeve 56 engages the top of the convexly bowed header 72. The lower actuator clamp portion 54 of the lower actuator sleeve 52 is placed so as to abut against the bottom of the vehicle bumper structure 60. In particular, the lower actuator sleeve 52 is moved in the axial direction of the vertically upright extension pole 40 such that the lower actuator clamp 54 abuts against cross member 64 of bumper structure 60. Cross member 64 is supported by vertical members 62*a* and 62*b* which depends from the bottom side 74 of the trailer door frame 70.

Figure 3:
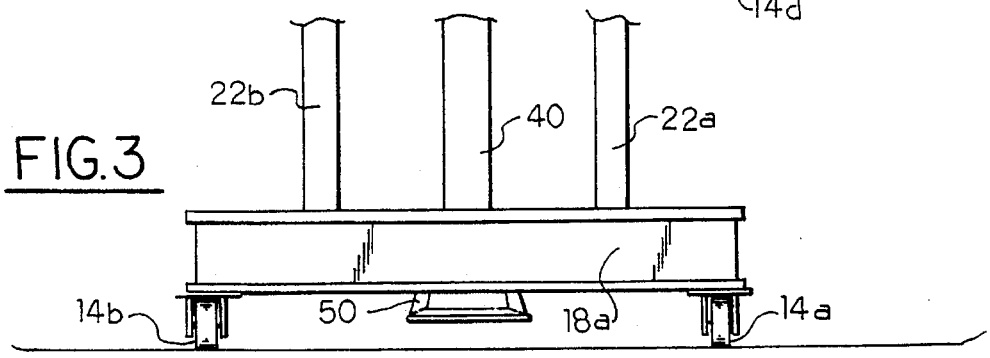
FIG. 3 is a front elevational view taken along sight line 3—3 of FIG. 2, showing a stabilization pad of the header alignment apparatus of the present invention raised from a flat surface within the header alignment apparatus is performing in a contraction mode.
Figure 6:
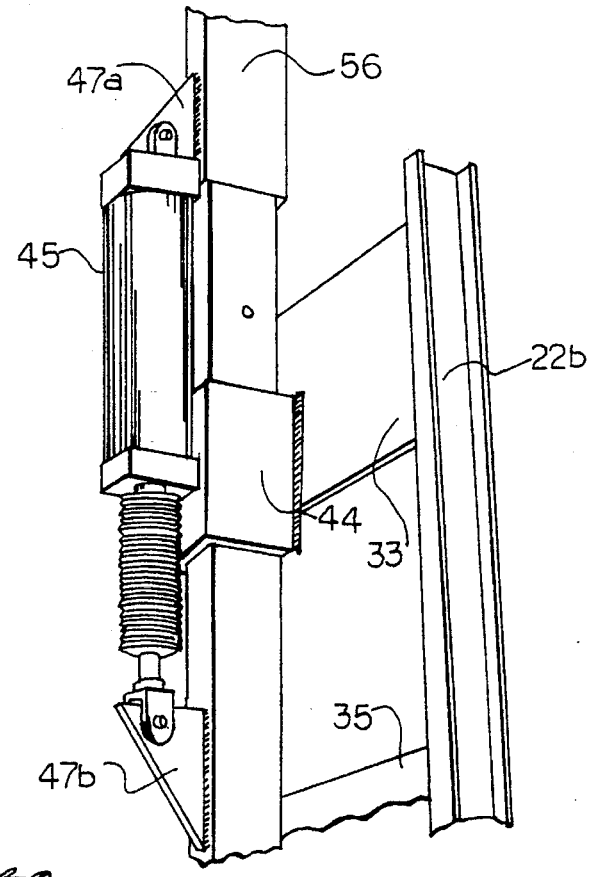
FIG. 6 is a perspective view of a self-centering ram of the present invention.

Referring now to FIG. 3 taken along sight line 3—3 of FIG. 2, the configuration and positioning of the vertically extending projection pole 40 is shown during a contraction mode of the self-centering ram 45. During the contraction mode stabilization pad 50 is raised from the flat surface or ground by upward movement of the extension pole 40, to which it is attached. The pole 40, pad 50, and the lower actuating clamp 54 are raised by contraction of the self-centering ram 45. Simultaneously, during this contraction mode, the upper actuator clamp 58 is moved downward against the convexly bowed header. As shown in FIG. 6, when the self-centering ram 45 is in contraction, the ram 45 moves ram attachment 47*b* upward, which is attached to the vertically upright extension pole 40, thereby raising the stabilization pad 50 off the flat surface or ground.

Figures 4, 5:
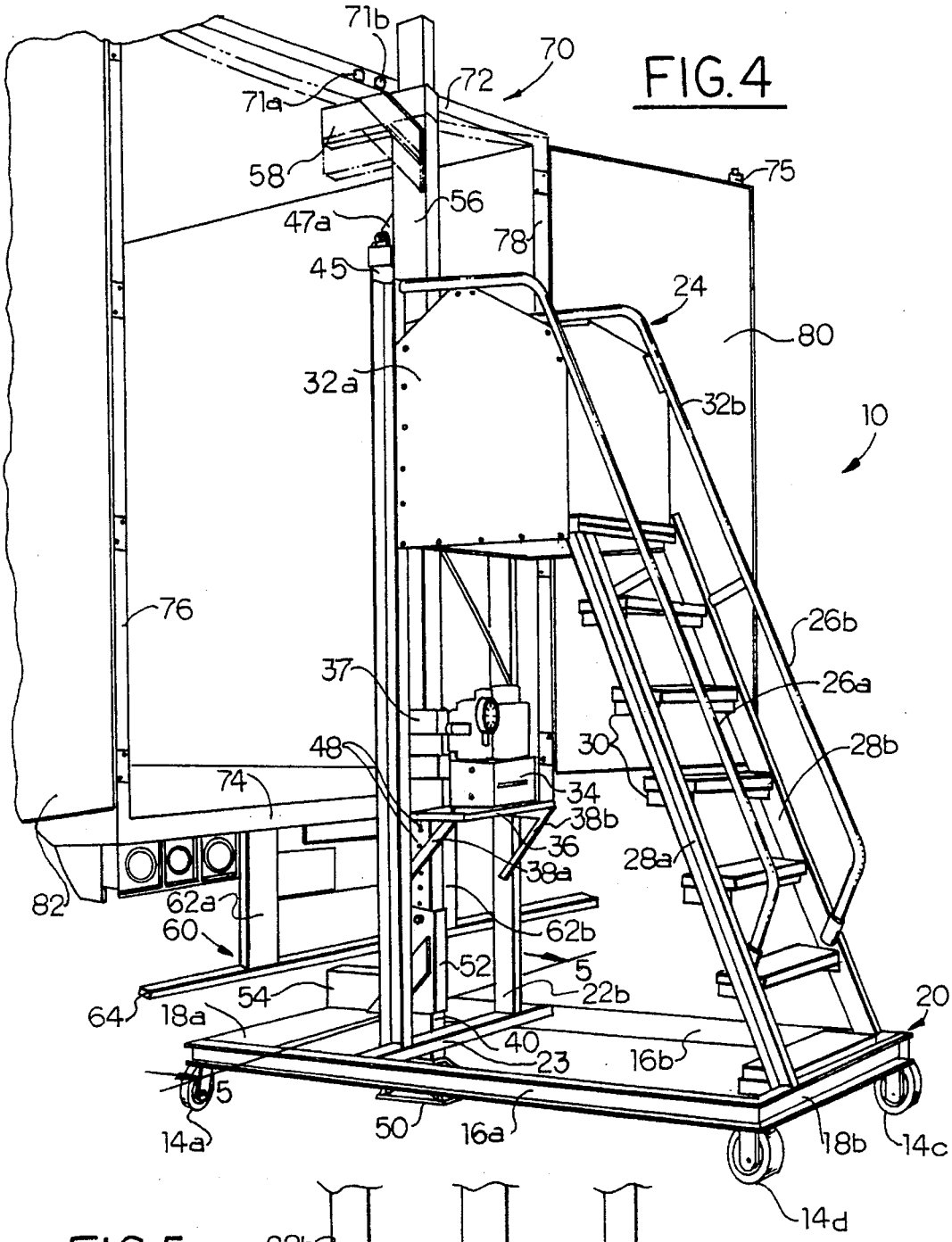
FIG. 4 is a perspective view of the header alignment apparatus of the present invention in position to align a header that is bowed in concave fashion.
FIG. 5 is a front elevational view taken along sight line 5—5 of FIG. 4, showing a stabilization pad of the header alignment apparatus of the present invention resting on a flat surface when the header alignment apparatus is performing in an expansion mode.

Referring to FIG. 4, the vehicle trailer door frame 70 is shown along with the vehicle header alignment apparatus 10 in a repair position. As shown in FIG. 2, the door frame 70 comprises a first side 76, a second side 78, a header 72, and a bottom side 74. In FIG. 4, the header 72 is bowed in downward concave fashion sufficiently to prevent the vehicle door latches 75, attached to a vehicle door 80, from engaging door latch retainer mechanisms 71*a* and 71*b*.

In operation, the header alignment apparatus 10 is positioned so that the upper actuator clamp 58 of the upper actuator sleeve 56 engages the bottom of the header 72. The lower actuator clamp 54 of the lower actuator sleeve 52 is positioned away from the vehicle bumper 60. Then, the header alignment apparatus 10 is operated in an expansion mode in which the concavely bowed header 72 is raised.

Referring now to FIG. 5 taken along sight line 5—5 of FIG. 4, the configuration and positioning of the vertically oriented extension pole 40 is shown during an expansion mode of self-centering ram 45. As shown, the stabilization pad 50 is in contact with the flat surface or ground during the expansion mode caused by downward movement of the pole 40, and the lower actuating clamp 54. Simultaneously, the upper actuation clamp 58 is moved upward or raised thereby raising the concavely bowed header 72. As best shown in FIG. 6, when the self-centering ram 45 is expanded, the ram 45 moves the ram attachment 47*b*, and the vertically upright extension pole 40 downward, thereby engaging the stabilization pad 50 with the flat surface or ground.

Figure 8:
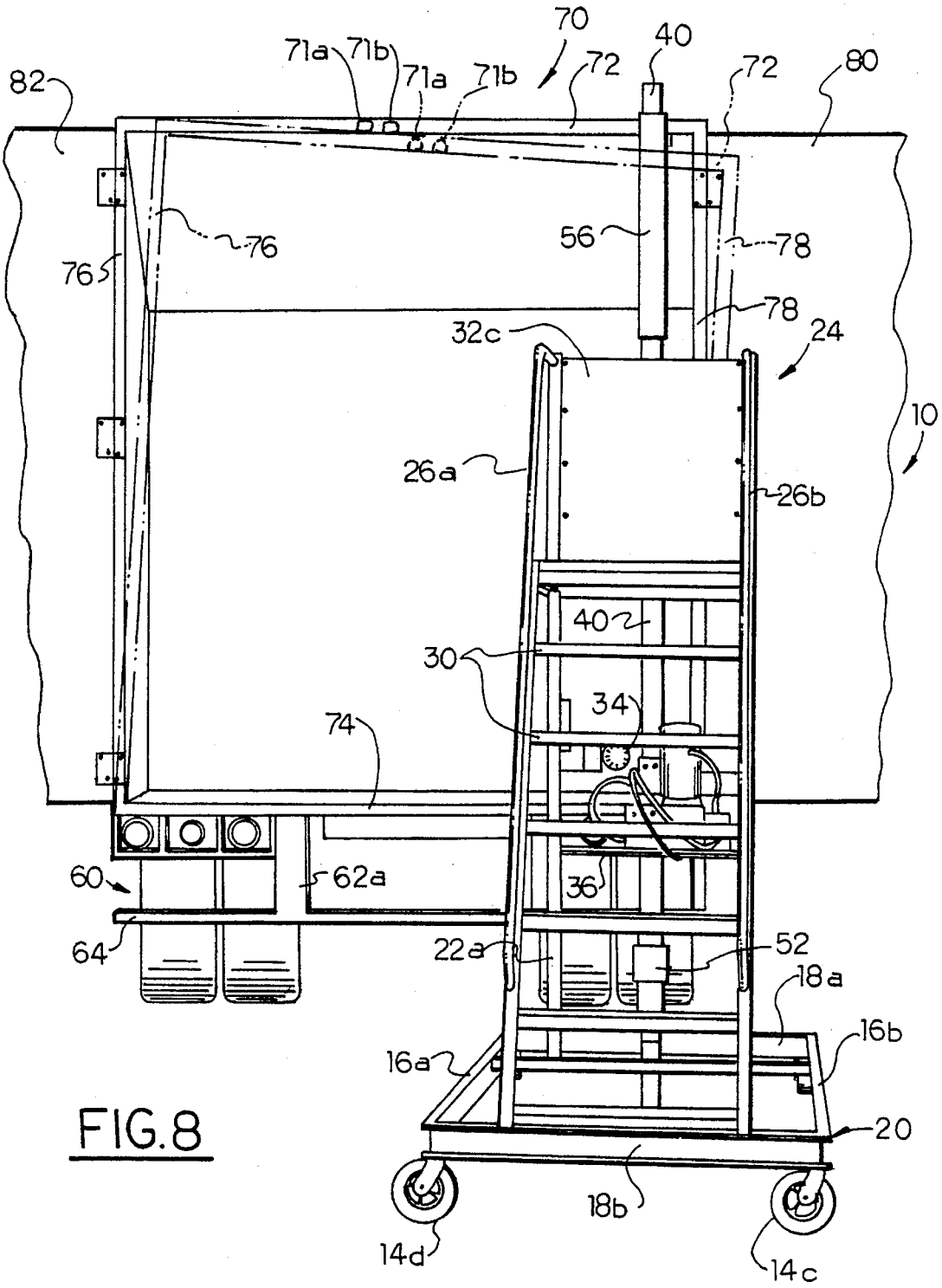
FIG. 8 is a perspective view of the header alignment apparatus of the present invention in position to align a header that is tilted to one side.

Referencing FIG. 8, the header alignment apparatus 10 is shown in an alignment position for a header 72 that is tilted to one side creating a non-rectangular opening. In operation, the alignment apparatus 10 is shown in an expansion mode. The stabilization pad 50 is in contact with the flat surface or ground. Simultaneously, during the expansion mode, the upper actuation clamp 58 is raised thereby biasing the tilted side of the header 72 toward a configuration which produces a rectangular opening.

While the invention has been described in detail, it is to be expressly understood that it will be apparent to persons skilled in the relevant art that the invention may be modified without departing from the spirit of the invention. Various changes of form, design or arrangement may be made to the invention without departing from the spirit and scope of the invention. Therefore, the above mentioned description is to be considered exemplary, rather than limiting, and the true scope of the invention is that defined in the following claims.

What is claimed is:

1. A header alignment apparatus for a vehicle having a bumper and a header, the header alignment apparatus having a contraction mode and an expansion mode, the header alignment apparatus comprising:

a substantially vertically upright extension pole for moving upward during the contraction mode and remaining in a set position during the expansion mode;

an L-shaped upper actuator sleeve having a tubular portion through which the vertically upright extension pole extends and an upper actuator clamp portion, integrally formed therewith, for engaging the header, the L-shaped upper actuator sleeve movable in the axial direction of the vertically upright extension pole;

an L-shaped lower actuator sleeve having a tubular portion through which the vertically upright extension pole extends and a lower actuator clamp portion, integrally formed therewith, for engaging the bumper, the L-shaped lower actuator sleeve adjustably attached to the vertically upright extension pole and movable in the axial direction of the vertically upright extension pole;

a self-centering ram operably attached to the L-shaped upper actuator sleeve at a first end and operably attached to the vertically upright extension pole at a second end between the adjustable L-shaped lower actuator sleeve and the L-shaped upper actuator sleeve, the self-centering ram performing a simultaneous function of lowering the upper actuator clamp and raising the lower actuator clamp so that a force is exerted on the header tending to move it lower during the contraction mode, and alternatively performing a simultaneous function of raising the upper actuator clamp and lowering the lower actuator clamp so that a force is exerted on the header tending to move it higher during the expansion mode;

a rectangular sleeve having the vertically upright extension pole inserted therethrough; and visualization means attached to the rectangular sleeve for allowing a service technician to visually inspect the header for proper alignment.

2. The header alignment apparatus for a vehicle of claim 1 wherein the visualization means comprises a ladder member.

3. The header alignment apparatus for a vehicle of claim 2 further comprising a platform having means for transferring the vertically upright extension pole from location to location.

4. A header alignment apparatus for a vehicle having a bumper and a header, the header alignment apparatus having a contraction mode and an expansion mode, the header alignment apparatus comprising:

at least one stabilization pad for abutting against a flat surface, the at least one stabilization pad remaining on the flat surface during the expansion mode and disengaging from the flat surface during the contraction mode;

a substantially vertically upright extension pole attached to the at least one stabilization pad, the vertically upright extension pole for moving upward during the contraction mode and remaining in a set position during the expansion mode;

an L-shaped upper actuator sleeve having a tubular portion through which the vertically upright extension pole extends and an upper actuator clamp portion, integrally formed therewith, for engaging the header, the L-shaped upper actuator sleeve movable in the axial direction of the vertically upright extension pole;

an L-shaped lower actuator sleeve having a tubular portion through which the vertically upright extension pole extends and a lower actuator clamp portion, integrally formed therewith, for engaging the bumper, the L-shaped lower actuator sleeve adjustably attached to the vertically upright extension pole and movable in the axial direction of the vertically upright extension pole;

lower actuator adjuster means for moving the adjustable L-shaped lower actuator sleeve in the axial direction of the vertically upright extension pole, the lower actuator adjuster means connects the vertically upright extension pole and the L-shaped lower actuator sleeve;

a self-centering ram operably attached to the L-shaped upper actuator sleeve at a first end and operably attached to the vertically upright extension pole at a second end between the adjustable L-shaped lower actuator sleeve and the L-shaped upper actuator sleeve, the self-centering ram performing a simultaneous function of lowering the upper actuator clamp and raising the lower actuator clamp so that a force is exerted on the header tending to move it lower during the contraction mode, and alternatively performing a simultaneous function of raising the upper actuator clamp and lowering the lower actuator clamp so that a force is exerted on the header tending to move it higher during the expansion mode;

a platform having at least one wheel attached thereto for transferring the vertically upright extension pole from location to location;

a rectangular sleeve having the vertically upright extension pole inserted therethrough; and visualization means attached to the rectangular sleeve for allowing a service technician to visually inspect the header for proper alignment.

5. The header alignment apparatus for a vehicle of claim 4 wherein the visualization means comprises a ladder member.

6. The header alignment apparatus for a vehicle of claim 5 wherein the vertically upright extension pole further comprises a plurality of bores extending therethrough.

7. The header alignment apparatus for a vehicle of claim 6 wherein the adjustable L-shaped lower actuator sleeve further comprises at least one bore extending therethrough.

8. The header alignment apparatus for a vehicle of claim 7 wherein the lower actuator adjuster means has a pin inserted through the bore of the L-shaped lower actuator sleeve and one of the plurality of bores of the vertically upright extension pole thereby connecting the L-shaped lower actuator sleeve and the vertically upright extension pole.

9. A header alignment apparatus for a vehicle having a bumper and a header, the header alignment apparatus having a contraction mode and an expansion mode, the header alignment apparatus comprising:

at least one stabilization pad for abutting against a flat surface, the at least one stabilization pad remaining on the flat surface during the expansion mode and disengaging from the flat surface during the contraction mode;

a substantially vertically upright extension pole attached to the at least one stabilization pad and having a plurality of bores extending therethrough, the vertically upright extension pole for moving upward during the contraction mode and remaining in a set position during the expansion mode;

an L-shaped upper actuator sleeve having a tubular portion through which the vertically upright extension pole extends and an upper actuator clamp portion, integrally formed therewith, for engaging the header, the L-shaped upper actuator sleeve movable in the axial direction of the vertically upright extension pole;

an L-shaped lower actuator sleeve having a tubular portion through which the vertically upright extension pole extends, at least one bore that extends therethrough in axial alignment with one of the plurality of bores of the vertically upright extension pole, and a lower actuator clamp integrally formed therewith, for engaging the bumper, the L-shaped lower actuator sleeve adjustably attached to the vertically upright extension pole and movable in the axial direction of the vertically upright extension pole;

a self-centering ram operably attached to the L-shaped upper actuator sleeve at a first end and operably attached to the vertically upright extension pole at a second end between the adjustable L-shaped lower actuator sleeve and the L-shaped upper actuator sleeve, the self-centering ram performing a simultaneous function of lowering the upper actuator clamp and raising the lower actuator clamp so that a force is exerted on the header tending to move it lower during the contraction mode, and alternatively performing a simultaneous function of raising the upper actuator clamp and lowering the lower actuator clamp so that a force is exerted on the header tending to move it higher during the expansion mode;

a pin for moving the L-shaped lower actuator sleeve axially along the vertically upright extension pole, the pin being inserted through the bore of the L-shaped lower actuator sleeve and one of the plurality of bores of the vertically upright extension pole;

a platform having at least one wheel attached thereto for transferring the vertically upright extension pole from location to location;

a first rectangular sleeve having the vertically upright extension pole inserted therethrough;

a second rectangular sleeve having the vertically upright extension pole inserted therethrough;

a ladder member attached to the first rectangular sleeve and the second rectangular sleeve at a first side and attached to the platform at a second side, the ladder member allowing a service technician to visually inspect the header for proper alignment; and a remote toggle switch for allowing the service technician to operate the self-centering ram from a remote location.

* * * * *